US010634019B2

(12) United States Patent
Mandell et al.

(10) Patent No.: US 10,634,019 B2
(45) Date of Patent: Apr. 28, 2020

(54) ROCKER ARM CONTROL SYSTEMS

(71) Applicant: Jacobs Vehicle Systems, Inc., Bloomfield, CT (US)

(72) Inventors: John Mandell, Vernon, CT (US); David M. Ferreira, Glastonbury, CT (US); Gabriel S. Roberts, Wallingford, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

(21) Appl. No.: 16/295,637

(22) Filed: Mar. 7, 2019

(65) Prior Publication Data

US 2019/0277170 A1 Sep. 12, 2019

Related U.S. Application Data

(60) Provisional application No. 62/639,993, filed on Mar. 7, 2018.

(51) Int. Cl.

| | |
|---|---|
| ***F01L 1/34*** | (2006.01) |
| ***F01L 13/00*** | (2006.01) |
| ***F01L 1/18*** | (2006.01) |
| ***F01L 13/06*** | (2006.01) |

(Continued)

(52) U.S. Cl.

CPC ..... *F01L 13/0005* (2013.01); *F01L 1/181* (2013.01); *F01L 1/267* (2013.01); *F01L 13/065* (2013.01); *F01L 2001/467* (2013.01); *F01L 2105/00* (2013.01); *F01L 2800/10* (2013.01)

(58) Field of Classification Search

CPC ..... F01L 13/0005; F01L 1/181; F01L 1/267; F01L 13/065; F01L 2800/10; F01L 2105/00; F01L 2001/467

See application file for complete search history.

(56) References Cited

U.S. PATENT DOCUMENTS

2004/0168658 A1* 9/2004 Sakai ..... F01L 1/022 123/90.15

FOREIGN PATENT DOCUMENTS

| | | |
|---|---|---|
| JP | 58165204 U | 11/1983 |
| JP | 6136112 U | 3/1986 |

(Continued)

OTHER PUBLICATIONS

International Search Report and Written Opinion for International Application No. PCT/US2019/021133, dated Jun. 18, 2019, 10 pages.

*Primary Examiner* — Zelalem Eshete

(74) *Attorney, Agent, or Firm* — Moreno IP Law LLC

(57) ABSTRACT

Systems for valve actuation in internal combustion engines with a dedicated rocker for actuating the at least one of two or more engine valves in a braking operation may include a biasing component, such as a compression spring, tension spring, spring catch, hydraulic actuator, pneumatic actuator for biasing the dedicated rocker in a biased direction away from the motion source, and a limiting component, such as a physical stop including a set screw or a stop integrated in the biasing component, for limiting the motion of the dedicated rocker in the biased direction. The biasing component and limiting component maintain the dedicated rocker in a controlled state and a positive, neutral position during operation.

20 Claims, 8 Drawing Sheets

(51) Int. Cl.
*F01L 1/26* (2006.01)
*F01L 1/46* (2006.01)

(56) References Cited

FOREIGN PATENT DOCUMENTS

| | | | |
|---|---|---|---|
| JP | 2004324478 | A | 11/2004 |
| WO | 2017220813 | A1 | 12/2017 |

* cited by examiner

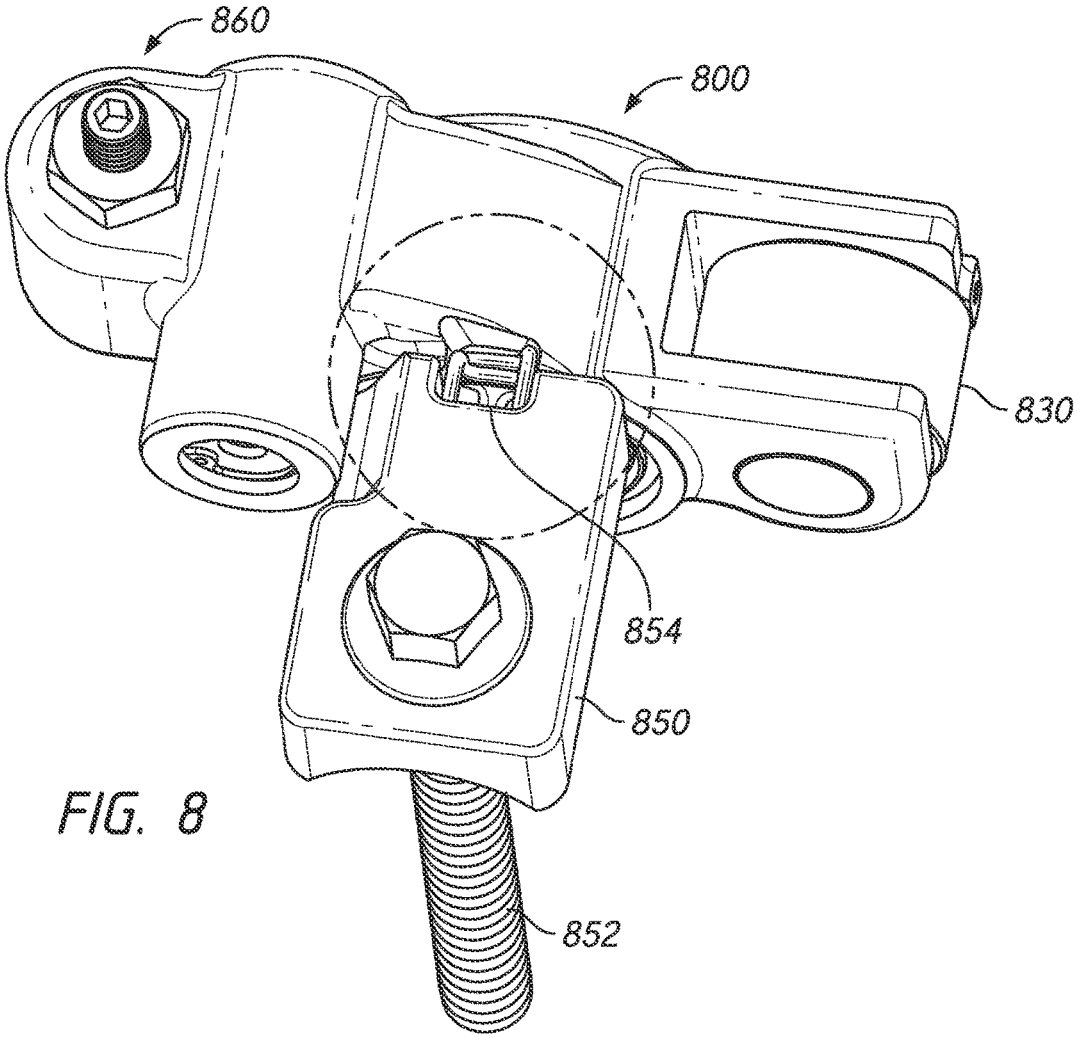
FIG. 8
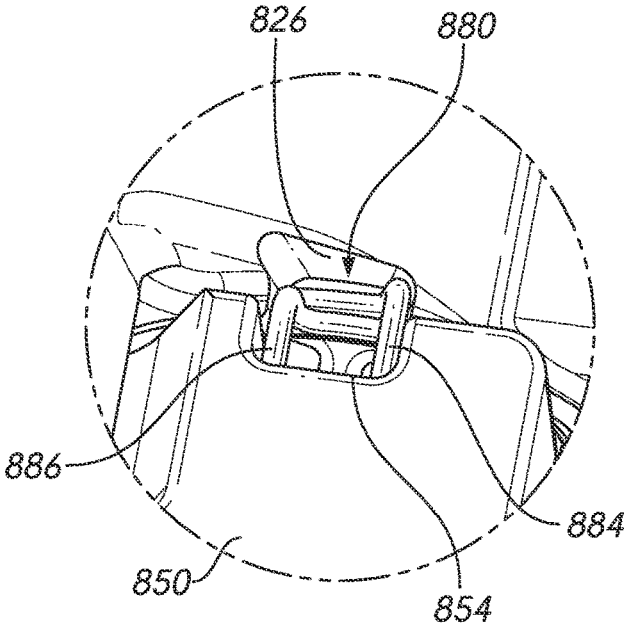
FIG. 8.1

ROCKER ARM CONTROL SYSTEMS

PRIORITY CLAIM AND CROSS-REFERENCE TO RELATED APPLICATIONS

This application claims the priority benefit of U.S. provisional application Ser. No. 62/639,993, titled SYSTEM FOR CONTROL OF A ROCKER ARM, filed on Mar. 7, 2018, the subject matter of which is incorporated by reference herein in its entirety.

FIELD

This disclosure relates generally to systems for cyclically operating valves in internal combustion engines. More particularly, this disclosure relates to engine valve actuation systems that utilize rocker arms in the engine valvetrain, including rocker arms that may be dedicated to controlling engine power by varying inlet and exhaust valve operating characteristics, such as in engine braking or other auxiliary valve motion operations in engine valvetrains. The disclosure further relates to systems for controlling motion of such rocker arms.

BACKGROUND

Internal combustion engines rely on valve actuation systems to control engine intake and exhaust valves, which in turn, control the flow of combustion components and products into and out of combustion chambers during operation. In a four-stroke operating cycle, intake valves are opened to admit fuel and air into an expanding combustion chamber during an intake stroke of a piston moving within a cylinder. In a compression stroke, the intake valves are closed and combustion components are compressed by the piston. The compressed combustion components are then ignited, causing a power stroke of the piston. In an exhaust stroke, exhaust valves are opened to allow combustion products to escape the cylinder as the piston is displaced therein. This operation is typically called a "positive power" operation of the engine and the motions applied to the valves during positive power operation are typically referred to as "main event" valve actuation motions. In addition to main event actuation, engine valve actuation systems may include features that facilitate auxiliary valve actuation motion to support functions such as engine braking (power absorbing), exhaust gas recirculation (EGR) and others. Such valve motion may be accomplished using "auxiliary" events imparted to one or more of the engine valves.

Valve movement is typically controlled by one or more rotating cams as motion sources. Cam followers, push rods, rocker arms and other elements, which may form a valvetrain, provide for direct transfer of motion from the cam surface to the valves. For auxiliary events, "lost motion" devices or variable length actuators may be utilized in the valvetrain to facilitate auxiliary event valve movement. Lost motion devices refer to a class of technical solutions in which valve motion is modified compared to the motion that would otherwise occur as a result of actuation by a respective cam surface alone. Lost motion devices may include devices whose length, rigidity or compressibility is varied and controlled in order to facilitate the selective occurrence of auxiliary events in addition to, or as an alternative to, main event operation of valves.

Auxiliary motion valve systems may utilize a dedicated rocker arm to support auxiliary events on one or more engine valves. In such systems, main event motion is facilitated by a main event rocker, while auxiliary motion is facilitated by the dedicated rocker, which is typically driven by a dedicated motion source, such as a cam. The dedicated rocker may include a piston actuator that is controlled to absorb or transfer motion. When the piston actuator is active (e.g., in an extended configuration), the dedicated rocker arm is said to be in an active state, and passes motion from a braking cam on to a motion receiving component, such as an engine valve. When the piston actuator is inactive (e.g., in a retracted configuration), the dedicated rocker is said to be in an inactive state. In the inactive state, the rocker may be disengaged from the braking cam as well as the valve. As such, the dedicated rocker may be in an uncontrolled state.

In conventional valvetrains, utilizing a cam follower and biasing mechanisms, such as valve springs or external springs, the rocker arm may operate in an controlled state where damage of motion imparting components (i.e., cam or cam surface) and motion receiving elements (engine valve or push rod. For example, at high operating speeds, acceleration of the cam and valvetrain components, combined with inertia of these components and the rocker arm, may cause separation between components in the valvetrain, such as the rocker arm, that should normally be in contact. This separation and the subsequent recontact of the components may result in damage to valvetrain contact surfaces and components and, in some cases, even possible contact between engine valves and pistons.

Prior art control devices have utilized biasing devices to provide some degree of control by biasing the cam follower end of a rocker toward the cam. In typical dedicated rocker systems, however, it is ordinarily not feasible to control rocker motion by providing a biasing force in an opposed direction, i.e., biasing the valve end of the rocker toward the valve and the cam follower end of the rocker away from the cam. This is because such configurations would cause the rocker to "chase" the valve or motion receiving component when the valve is subjected to main event motion via, for example, a valve bridge as known in the art.

In systems that incorporate variable valve actuation components, which may have active and inactive states, maintaining controlled operation of the rocker arm may be even more important. In a valvetrain with a variable actuator in a deactivated state, there may be more clearance between components in a valvetrain. As such, an uncontrolled rocker arm may compound the potential for contact surfaces to "chase" or become separated during operation, leading to high impact forces upon recontact and excessive wear and/or damage to components.

It would therefore be advantageous to provide systems that address the aforementioned shortcoming and others in the prior art.

SUMMARY

Responsive to the foregoing challenges, the instant disclosure provides various embodiments of valve actuation systems that maintain controlled operation of the rocker at all times.

According to one aspect, a system for actuating at least one of two or more engine valves in an internal combustion engine may comprise at least one dedicated rocker for actuating the at least one of two or more engine valves in an auxiliary operation; a motion source, such as a cam, pushrod or additional rocker arm, for imparting motion to a motion source side of the dedicated rocker; a motion receiving component, such as an engine valve, valve bridge, or another rocker arm, for receiving motion from a motion receiving component side of the dedicated rocker; and a rocker motion control assembly for controlling motion of the dedicated rocker, the rocker motion control assembly comprising: a biasing component, such as a compression spring, tension spring, spring catch, hydraulic actuator or pneumatic actuator for biasing the dedicated rocker in a biased direction away from the motion source; and a limiting component, such as a physical stop including a set screw or a stop integrated in the biasing component, for limiting the motion of the dedicated rocker in the biased direction.

According to another aspect, the described rocker control systems maintain the rocker arm in a controlled state throughout operation, whether the rocker is in an active state in which it is conveying motion from a motion source to a motion receiving component, or an inactive state in which it is not conveying motion. The described rocker control systems may provide for easier packaging in a valvetrain, have reduced costs, improved response times, improved durability and reduced engine parasitic losses.

Other aspects and advantages of the disclosure will be apparent to those of ordinary skill from the detailed description that follows and the above aspects should not be viewed as exhaustive or limiting. The foregoing general description and the following detailed description are intended to provide examples of the inventive aspects of this disclosure and should in no way be construed as limiting or restrictive of the scope defined in the appended claims.

DESCRIPTION OF THE DRAWINGS

The above and other attendant advantages and features of the invention will be apparent from the following detailed description together with the accompanying drawings, in which like reference numerals represent like elements throughout. It will be understood that the description and embodiments are intended as illustrative examples according to aspects of the disclosure and are not intended to be limiting to the scope of invention, which is set forth in the claims appended hereto.

FIGS. 8, 8.1 and 9 are isometric views of a sixth implementation of a rocker control system.

DETAILED DESCRIPTION

Figure 1:
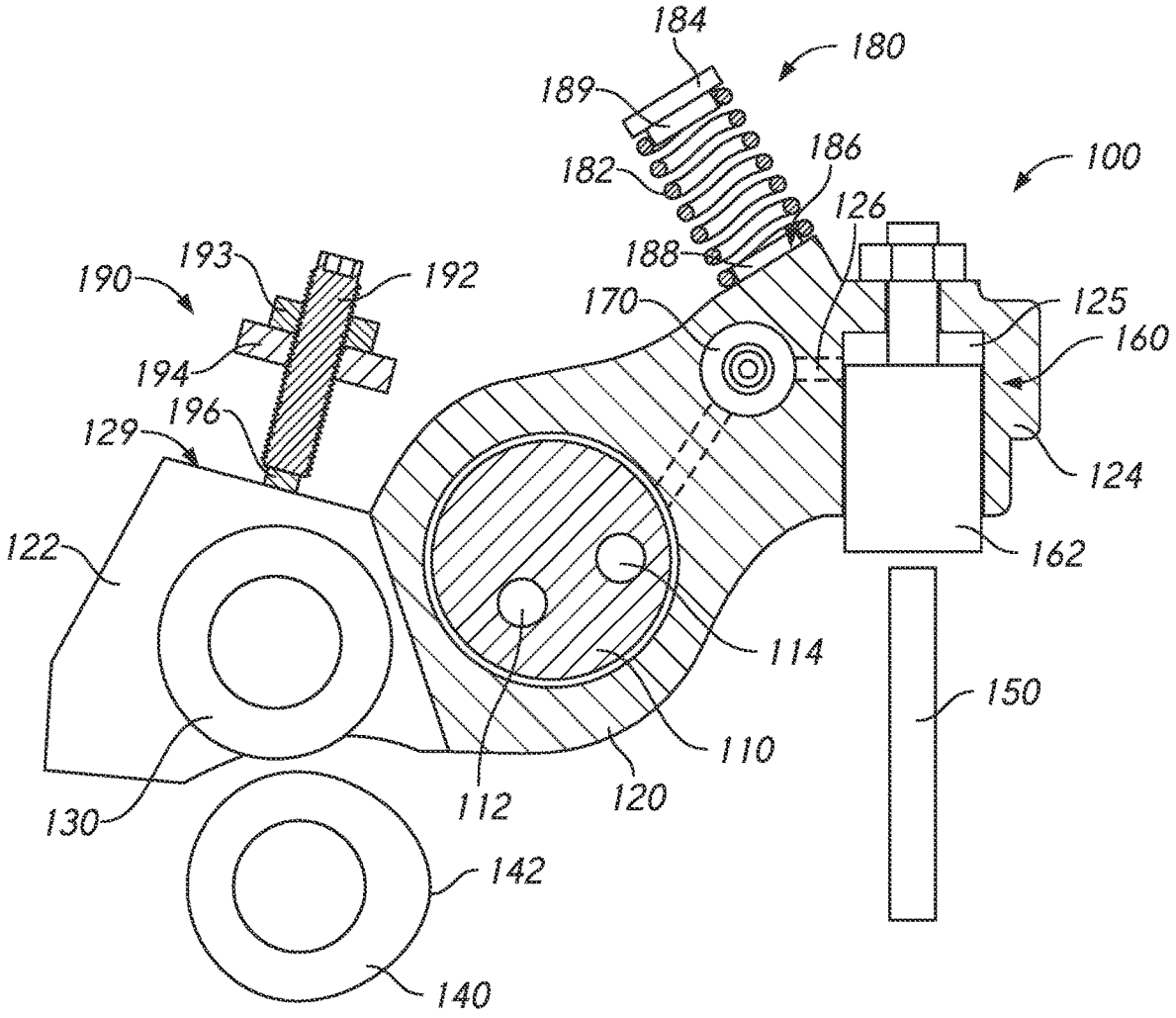
FIG. 1 is a schematic, partial cross-sectional illustration of an example implementation of a rocker control system.

FIG. 1 is a schematic diagram of an example rocker control system 100 according to aspects of the disclosure. The general environment for implementing control system 100 may include a rocker arm shaft 110, shown in cross-section, having a dedicated auxiliary rocker arm 120 pivotally mounted thereon. The rocker arm shaft 110 may include passages 112 and 114 for the flow of control fluid, such as oil provided at an operating pressure by pump components (not shown). Rocker arm 120 may include a motion source side 122 having a cam roller 130 mounted thereon for engaging a cam 140, which constitutes a motion source for providing motion to the rocker arm 120 via cam roller 130. Rocker arm 120 may also include a motion receiving component side 124, for imparting motion to a motion receiving component, such as an engine valve 150. Rocker motion source side 122 and motion receiving component side 124 as used herein may refer to any portion of the rocker arm 120 on a respective side of the center axis of rocker arm shaft 110, for example. The motion receiving component side 124 of the rocker arm 120 may include an actuation cylinder 125 formed therein for housing components of an actuator piston assembly 160, which may be selectively actuated by hydraulic control fluid supplied via control passage 126 under control of a control valve 170, which is also housed in the rocker arm 120. Control valve 170 may cause actuator piston assembly 160 (schematically illustrated) to assume an activated state, in which the piston 162 is extended from the actuation cylinder 125, or a deactivated state, in which the piston 162 is retracted into the actuation cylinder 125. In the activated state, the control valve 170 establishes a locked volume of hydraulic fluid with the actuator cylinder 125 such that the actuator piston assembly 160 is in a hydraulically rigid state so as to impart rocker arm motion to the valve 150 in a braking or other auxiliary action. Other intermediate valvetrain components such as a valve bridge or bridge pin may be disposed between the actuator piston 162 and stem of valve 150. In the deactivated state, which typically occurs during positive power operation of the internal combustion engine, the actuator piston assembly is in a hydraulically passive state, i.e., the control valve 170 permits hydraulic fluid to evacuate from the actuator cylinder 125, and the piston 162 is retracted into the actuation cylinder 125 under force from an internal spring (not shown) so as to create a gap or lash space between the end of the stem of engine valve 150. Moreover, in the deactivated state, the lash space is present throughout the full rotation of the cam 140, with a gap between the piston 162 and valve 150 existing both when the cam roller encounters the peak of the cam lobe 142, which represents an outer base circle, and the cam inner base circle. Thus, during positive power operation of the engine, throughout full rotation of the cam 140, the actuator piston 162 will not be in contact with the valve 150, or other intermediate valvetrain components. Moreover, the cam roller 130 may be out of contact with the surface of cam 140.

In accordance with aspects of the disclosure, a biasing component 180 may be provided to enhance control of the rocker arm 120. The biasing component may include a compression spring 182 disposed between a fixed support 184 and a portion of the rocker arm 120 on the motion receiving component side 124. The rocker arm may include a flat surface 186 for engaging the bottom of the spring 182, and a raised, circular spring guide 188, which may coincide with the internal diameter of spring 182, may extend from the flat surface 186. The fixed support 184 may be a plate or ledge extending from a cam cap or post secured to the engine head. Fixed support 184 may include an upper circular spring guide 189 extending therefrom to increase support and stability of the compression spring 182. The biasing component thus provides a constant biasing force on the rocker arm in a direction that is away from the cam roller. That is, the biasing direction tends to keep the cam roller displaced from the cam surface and tends to bias the rocker arm motion component receiving end in a direction towards the valve 150. Moreover, the strength of the compression spring 182 may be selected to be lighter (i.e., a lower spring constant) than that of the valve spring on the engine. This configuration will permit the biasing spring 182 to compress when the variable actuator is in an activated or extended state such that the rocker arm may pivot to permit the cam roller to contact the cam surface and take up any gaps therebetween In accordance with aspects of the disclosure, the control system 100 may include a limiting component 190 for limiting motion of the rocker arm 120 in the biased direction. Limiting component 190 may include a physical stop for limiting the motion of the motion source end 122 of the rocker arm 120. The physical stop may be in the form of a set screw 192 which is adjustably supported on a fixed mounting plate 194 and may include a rocker engaging end 196. Mounting plate 194 may be fixed on a cam cap or post fastened to the cylinder head. The rocker 120 may be provided with a flat surface 129 for engaging the set screw 192. A locking fastener 193 may be provided to lock the set screw 192 in position relative to the mounting plate 194. As will be recognized, the implementation shown in FIG. 1 may be used without the limiting component or physical stop as the biasing component will keep the rocker arm in contact with the motion receiving element (engine valve) at all times. When in an engine braking mode, the actuator piston will overcome the biasing force and push the rocker cam roller into contact with the cam.

As will be recognized, the combination of the biasing component 180 and the limiting component 190 will operate to maintain the rocker arm 120 in a controlled, positively defined neutral position during positive power operation of the engine, or when the rocker arm 120 is otherwise out of contact with other components in the valvetrain. It will further be recognized that the limiting component and biasing component described above and further described in different implementations herein, may be positioned in different locations on the rocker arm without departing from the inventive aspects set forth in this disclosure.

Figure 2:
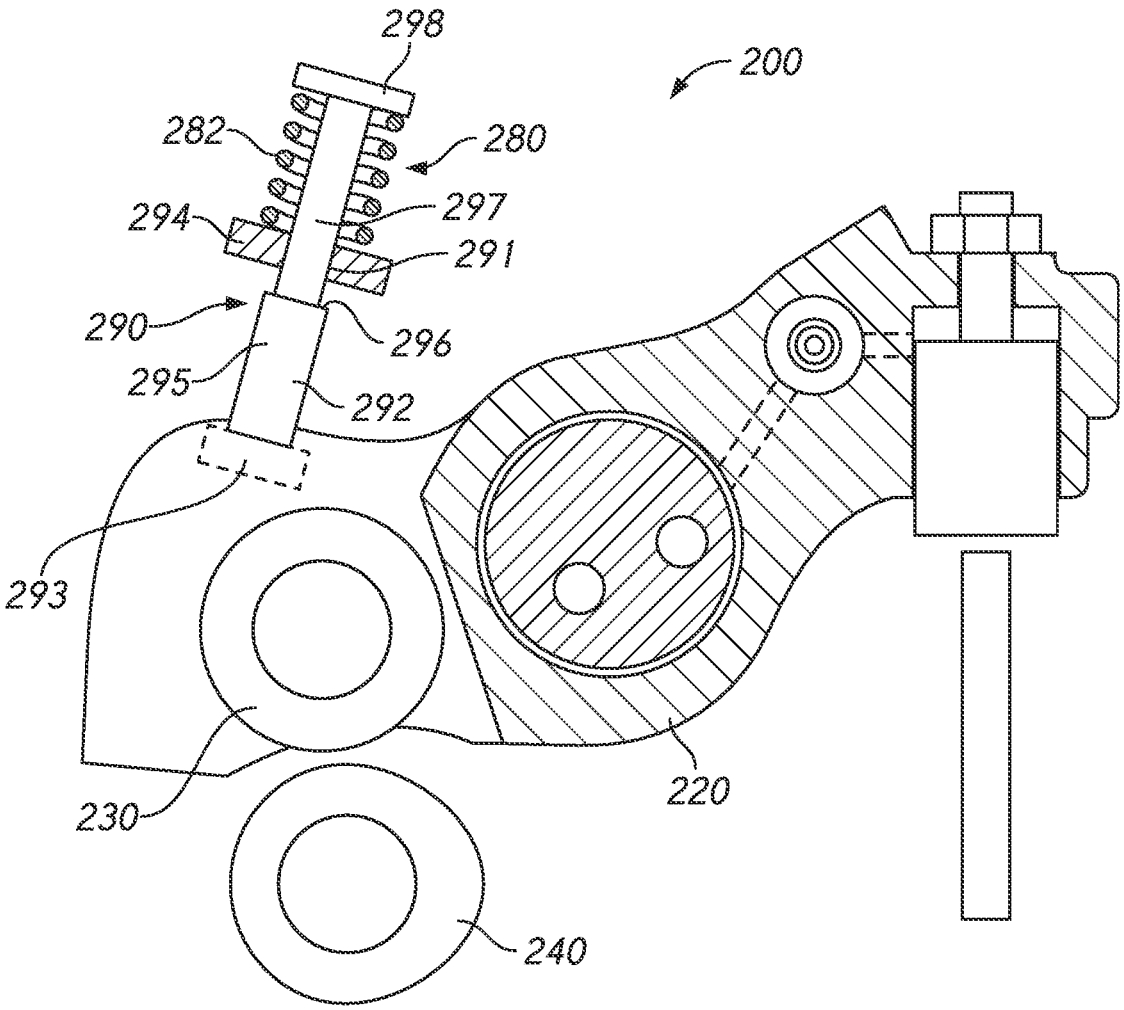
FIG. 2 is a schematic, partial cross-sectional illustration of second example implementation of a rocker control system.

FIG. 2 is a schematic illustration of another example rocker arm control system 200 according to aspects of the disclosure. In this example, the limiting component 290 is integrated into the biasing component 280, which exerts an upward force on the motion source side 222 of the rocker arm 220. A pin or bolt 292 may include a head portion 293 that is captive in, or otherwise fastened to the motion source side 224. Pin or bolt 292 may also include a stop section 295 terminating in a shoulder 296, and a guide section 297 extending further upward to a spring retaining plate 298, which may be threadably fastened to a terminal end of guide section 297. Guide section 297 extends through a passage 291 in a fixed guide plate 294, which may be secured to the engine cylinder head and/or extend from a post secured to the engine cylinder head. A compression spring 282 is disposed between an upper surface of the fixed guide plate 294 and the spring retaining plate 298 and exerts an upward force thereon, thus biasing the motion source end 222 and cam roller 230 of the rocker arm 120 in a direction away from the cam 240. As will be recognized, the upward travel of the guide portion 297, and thus the rocker arm 220, is limited by the shoulder 296, which is of a larger dimension (diameter) of the passage 291 in the fixed guide plate 294. The shoulder 296 is illustrated in a position that is displaced from the fixed guide plate 294 in order to show detail. It will be recognized that the control system 200 operates to maintain the rocker arm 220 in a positively defined, neutral position, as the spring 282 retains the shoulder 296 against the fixed guide plate 294, during main event motion (i.e., when motion source and motion receiving component forces are not applied to the rocker arm).

Figure 3:
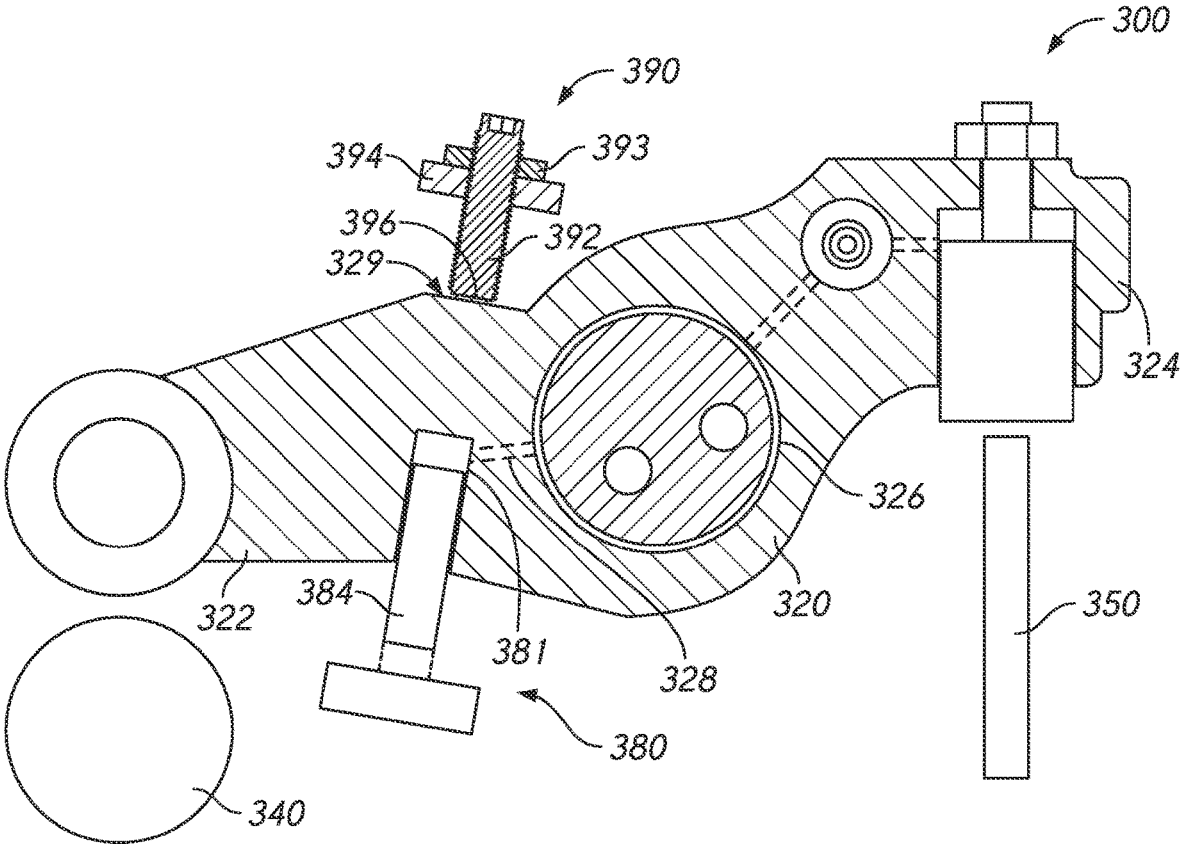
FIG. 3 is schematic, partial cross-sectional illustration of a third example implementation of a rocker control system.

FIG. 3 is a schematic illustration of another example rocker arm control system 300, in which the biasing component 380 may be in the form of a hydraulic component disposed on the motion source side 322 of the rocker arm 320. The hydraulic component may include a hydraulic cylinder 381 formed in the rocker arm 380 and in fluid communication with a control fluid passage 328, also formed in the rocker arm 380 and extending to the rocker shaft bore 326 to receive pressurized hydraulic fluid. A hydraulic piston 384 may be disposed in the hydraulic cylinder and will be biased outward from the rocker arm 320 by the pressurized hydraulic fluid in the cylinder 381. A stop plate 388 may be affixed to the engine cylinder head. When the piston 384 contacts the stop plate 388, a biasing force will be exerted by the piston 384 on the rocker arm 322 in an upward direction, thus biasing the rocker arm motion source side 322 away from the cam 340. A limiting component 390 may limit the motion of the rocker arm 320 in the biased direction. Limiting component 390 may be similar to that described relative to FIG. 1 and may include a physical stop for limiting the motion of the motion source end 322 of the rocker arm 322. The physical stop may be in the form of a set screw 392 that may be adjustably supported on a fixed mounting plate 394 and may include a rocker engaging end 396 for engaging a flat area 329 of the rocker arm 320. Mounting plate 394 may be fixed on a cam cap or post fastened to the cylinder head. A locking fastener 393 may be provided to lock the set screw 392 in position relative to the mounting plate 394. To control the biasing force of the hydraulic component, pressure regulation devices or controls may be provided in communication with the control fluid passage 328 and the hydraulic cylinder 381.

Figure 4:
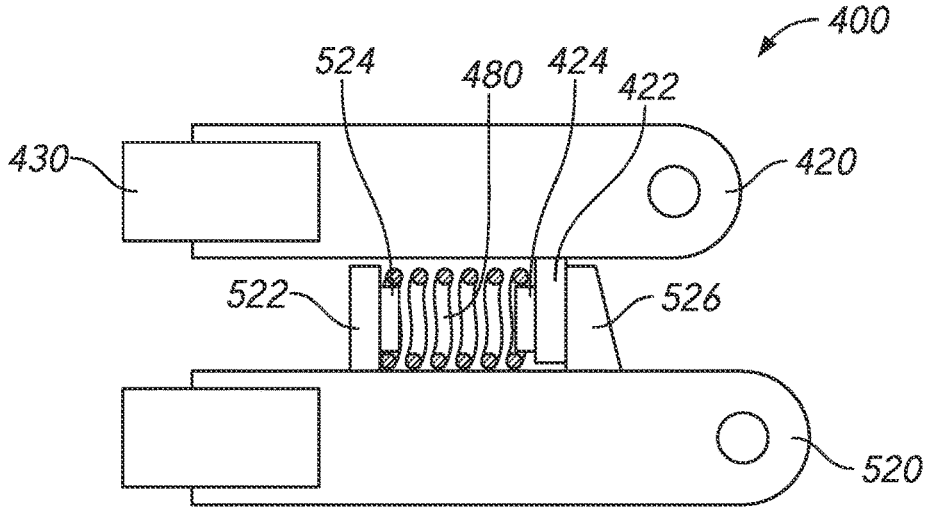
FIGS. 4 and 5 are schematic illustrations of a top view and side view, respectively, of a fourth example implementation of a rocker control system.
Figure 5:
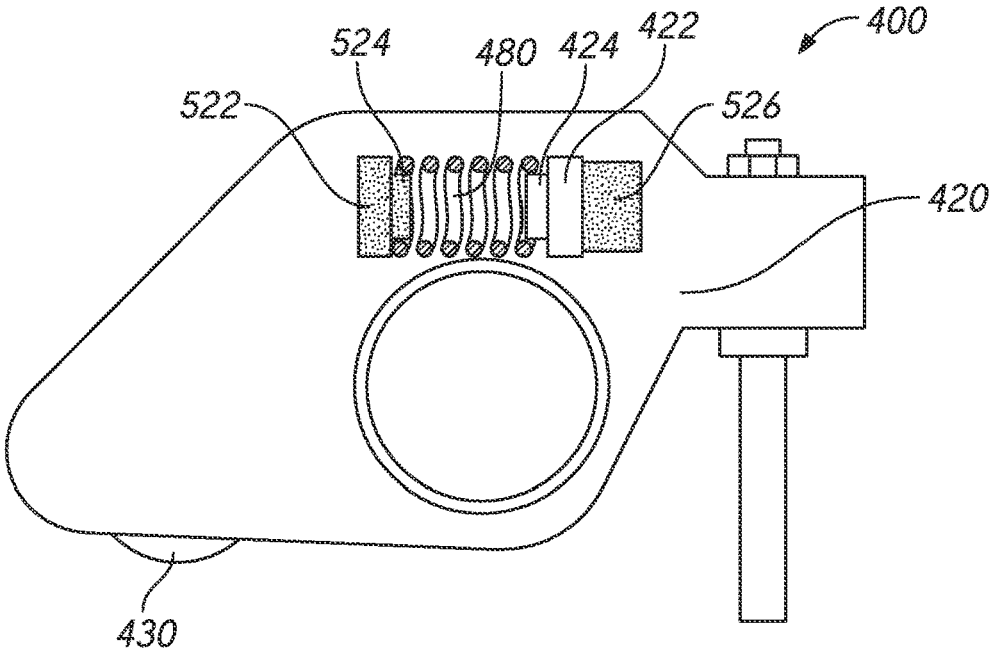

FIGS. 4 and 5 illustrate another example rocker control system 400 for a dedicated rocker arm 420 in which a biasing component and limiting component are implemented using elements that are situated between and cooperate with a dedicated (auxiliary) rocker arm 420 and a main event rocker arm 520. FIG. 4 is a top view and FIG. 5 is a side view schematic illustration of the dedicated (auxiliary) rocker 420. In FIG. 5, the main event rocker body has been omitted. However, the elements on the main event rocker that interact with elements on the brake rocker 420, namely the main event rocker stop tab 526 and main event rocker spring support 522, are shown as shaded elements (stippling). In this example, a biasing component for the dedicated rocker 420 may include a compression spring 480 and a dedicated rocker spring support 422 extending from the brake rocker 420. The dedicated rocker spring support 422 may include a first circular spring guide 424, having a diameter that corresponds to the inner diameter of spring 480, for retaining the spring in a positive position and for stability. An opposite end of spring 480 engages a main event rocker spring support 522, which may include a second circular spring guide 524. In the example system 400 in FIGS. 4 and 5, a limiting component may comprise main event rocker stop tab 526, which extends from the main event rocker 520 and is adapted to engage the dedicated rocker spring support 422. In this configuration, the brake rocker 420 is biased in a direction tending to move the cam roller 430 away from the cam (clockwise in FIG. 5). Moreover, the main event rocker stop tab 526 provides a limit on the travel of the dedicated rocker in the biased direction, thus positively defining a neutral position for the dedicated rocker 526, relative to the main event rocker motion during the deactivated state of the brake rocker. As will be recognized from the instant disclosure, the "positive" position of the dedicated rocker in this example, in contrast to the static positions assumed by the rocker arms in the examples in FIGS. 1-3 above, is defined relative to the motion of the main event rocker 520. Thus, during main event motion, with the dedicated rocker in a deactivated state, the dedicated rocker moves positively with the main event rocker and the cam roller remains out of contact with the cam, even when the cam outer base circle is aligned with the cam roller. When the dedicated rocker is in an activated state, the main event rocker ratio may create a large gap between the dedicated rocker actuator piston and the valve end. The dedicated rocker actuator piston then extends and, during the handoff condition from main event to auxiliary operation, the spring 480 is compressed and the brake rocker moves in a direction in which the cam roller 430 moves toward the cam, thus bringing the brake rocker motion under control of the cam surface in an auxiliary operation cycle.

Figure 6:
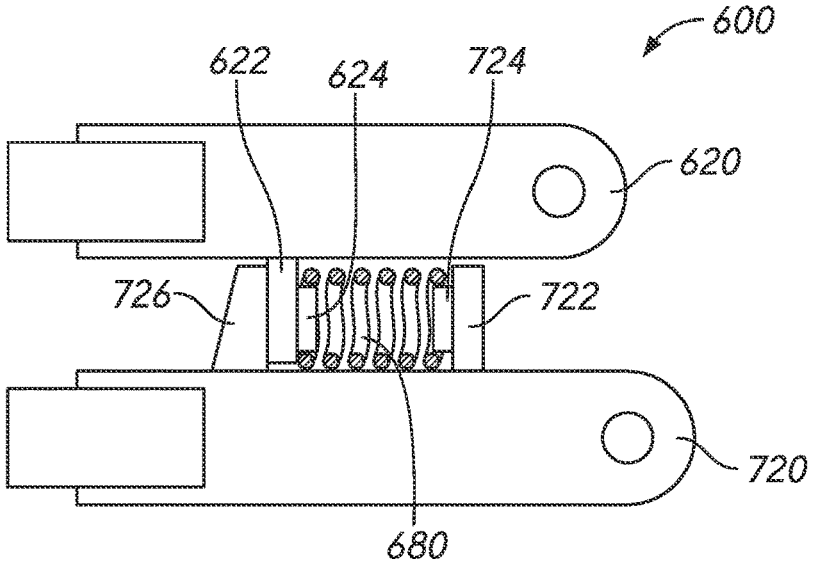
FIGS. 6 and 7 are schematic illustrations of a top view and a side view, respectively, of a fifth implementation of a rocker control system.
Figure 7:
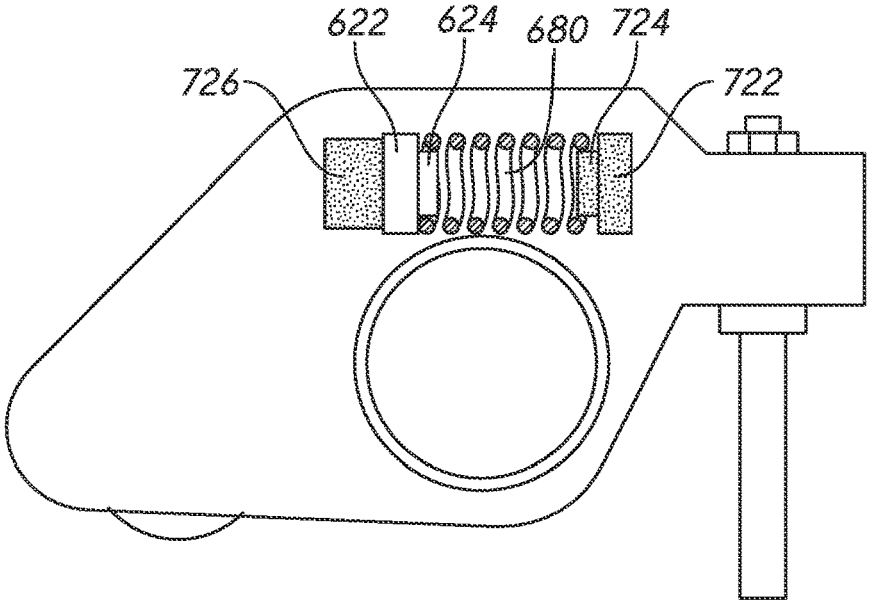
Figure 9:
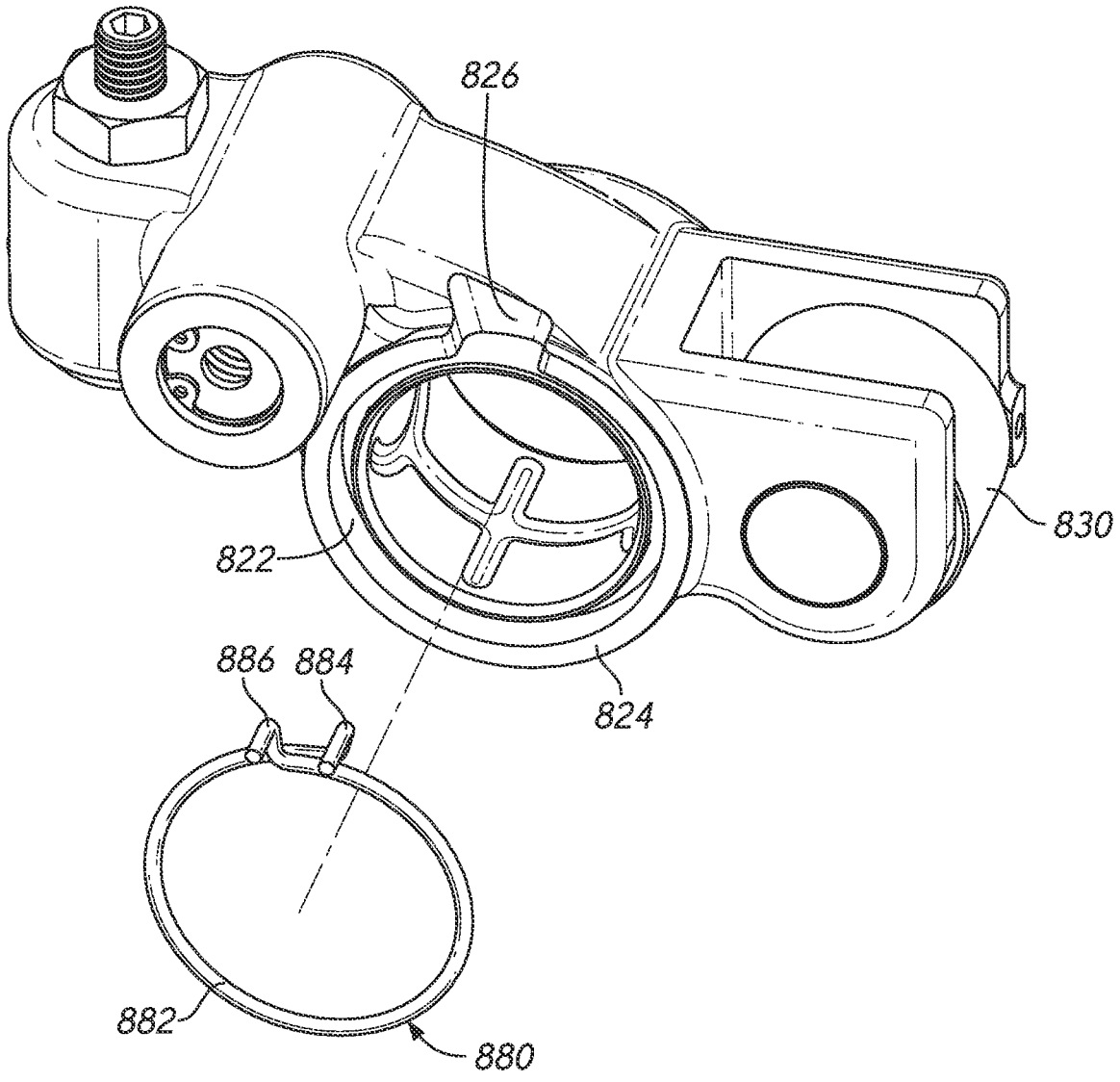

FIGS. 6 and 7 illustrate another example control system 600 which is a modified version of the system of FIGS. 4 and 5 for providing a biasing force on the dedicated rocker 620 in a direction tending to put the cam roller 630 in contact with the cam. FIG. 6 is a top view and FIG. 7 is a side view schematic illustration of the dedicated rocker 620. In FIG. 7, the main event rocker body has been omitted. However, the elements on the main event rocker that interact with elements on the dedicated rocker 620, namely the main event rocker spring support 722 and main event rocker stop tab 726, are shown as shaded elements (stippling). In this example, a biasing component for the dedicated rocker 620 may include a compression spring 680 and a dedicated rocker spring support 622 extending from the dedicated rocker 620. The dedicated rocker spring support 622 may include a first circular spring guide 624, with a diameter that corresponds to the inner diameter of spring 680, for retaining the spring in a positive position and for stability. An opposite end of spring 680 engages a main event rocker spring support 722, which may include a second circular spring guide 724. In the example system 600 in FIGS. 6 and 7, a limiting component may comprise main event rocker stop tab 726, which extends from the main event rocker 720 and is adapted to engage the dedicated rocker spring support 622. In this configuration, the dedicated rocker 620 is biased in a direction tending to move the cam roller 430 toward from the cam (counterclockwise in FIG. 7). Moreover, the main event rocker stop tab 726 provides a limit on the travel of the brake rocker in the biased direction, thus defining a positive position for the dedicated rocker 620, relative to the main event rocker motion, during the deactivated state of the dedicated rocker. It will be recognized that, the auxiliary (dedicated) rocker 620 will be biased into contact with the cam when on base circle. Moreover, when the actuator piston is activated, there may still be a small gap between the auxiliary rocker spring tab 622 and the main event rocker stop tab 726. The main event rocker stop tab 726 will typically be in contact with the dedicated rocker spring support 622 during main event lift portion of operation. As will be recognized from the instant disclosure, the "positive" position of the dedicated rocker in this example, in contrast to the static positions assumed by the rocker arms in the examples in FIGS. 1-3 above, is defined relative to the motion of the main event rocker 720. Thus, during main event motion, with the dedicated rocker in a deactivated state, the dedicated rocker 620 moves in a positively defined position with the main event rocker and the cam roller remains out of contact with the cam, even when the cam outer base circle is aligned with the cam roller. When the dedicated rocker is in an activated state, the main event rocker ratio may create a large gap between the dedicated rocker actuator piston and the valve end. The dedicated rocker actuator piston then extends and, during the handoff condition from main event to auxiliary operation, the spring 680 is compressed and the dedicated rocker moves in a direction in which the cam roller 630 moves toward the cam, thus bringing the dedicated rocker motion under control of the cam surface in an auxiliary operation cycle.

FIGS. 8, 8.1 and 9 are isometric views of an example rocker control system 800 which utilizes a torsion spring 880 situated around the rocker shaft and adapted to maintain the rocker 820 in a positively defined neutral, centered position in which the rocker 820 is out of contact with the motion source and the motion receiving component. Torsion spring 880 may include a main body 882 disposed within a recess 822 and in a generally concentric orientation relative to the rocker journal 824. The main body 882 may include a motion source side extension 884 and a motion receiving component side extension 886, both housed within a recess 826 in the rocker 820 and both abutting respective walls of the recess 826. A retaining plate 850, which may be fixed to the engine cylinder head with a fastening bolt 852, includes a retaining plate recess 854 that limits the travel of the motion source side extension 884 and the motion receiving component side extension 886 of the torsion spring 880 relative to retaining plate 850. As will be appreciated, the extensions 884 and 882 may undergo limited displacement from the walls of retaining plate recess 854 when the rocker 820 rotates. Thus, rotation of the rocker 820 in both rotational directions is thereby limited. When the rocker 820 is in a deactivated state, during main event operation, the rocker 820 is maintained in a static position by the torsion spring 880. When the rocker 820 is in an activated state, during auxiliary operation, the actuator piston 860 extends, rotating the rocker 820 against the biasing force provided by the extension 886 and causing the cam roller 830 to take up any gap with the cam. rocker 820 in a centered position. The motion receiving component side extension 886 exerts a biasing force on the rocker that tends to keep the rocker cam roller 830 out of contact with and away from the cam. When auxiliary operation is subsequently deactivated, the rocker 820 returns to its centered, controlled neutral position under control of the torsion spring 880.

Figure 10:
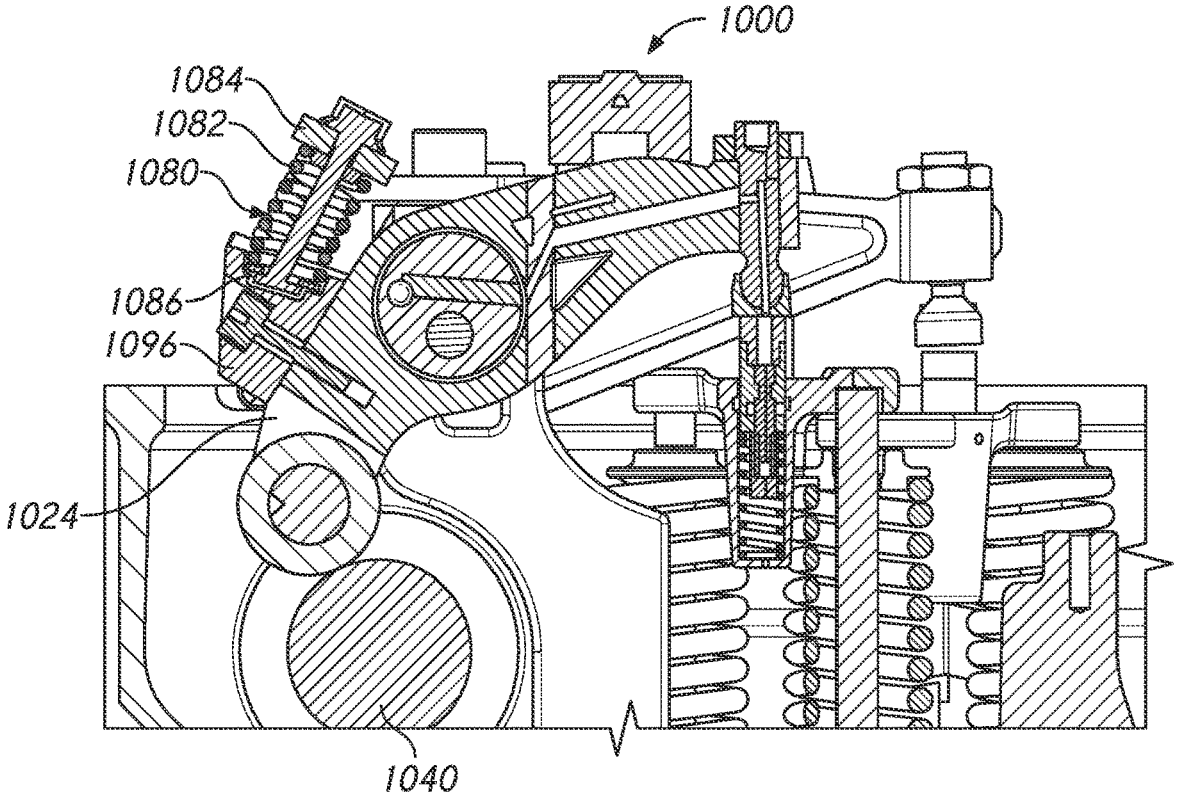
FIGS. 10 and 11 are schematic illustrations of a seventh implementation of a rocker control system.
Figure 11:
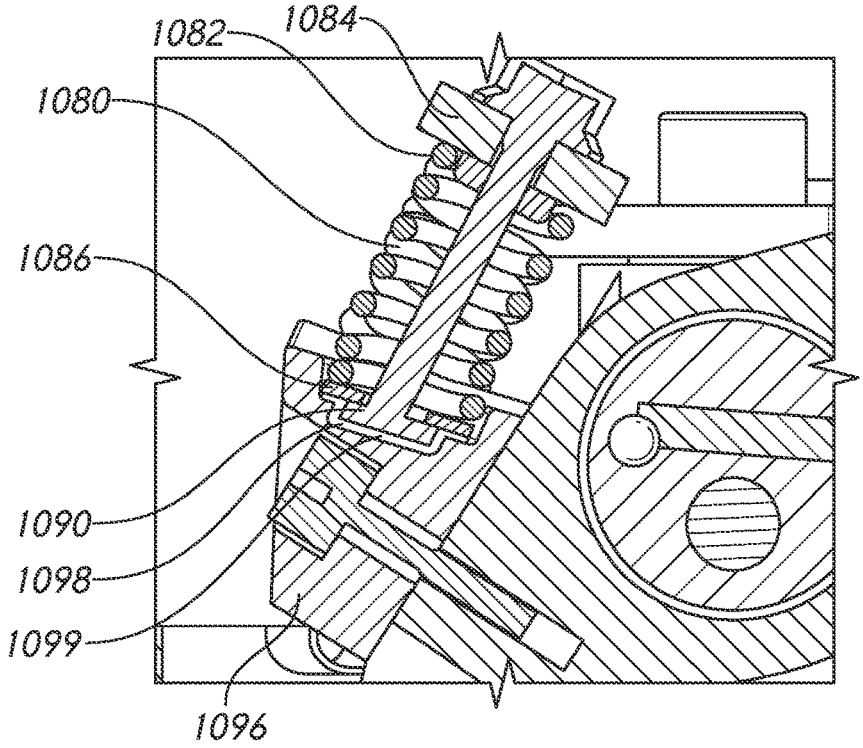

FIGS. 10 and 11 are schematic illustrations of another rocker control system 1000 in which a biasing component 1080 provides a biasing force on the rocker motion source side 1024 in the direction of the cam 1040. A compression spring 1082 is disposed between a fixed support plate 1084, which is fixed relative to the cylinder head, and a spring retainer 1086 on an opposite end. Spring retainer 1086 is supported on a retaining flange 1090 secured to the end of a threaded fastener 1092 that extends through the fixed support plate 1084. The expanse of spring 1082 is thus limited by the retaining flange 1090. A spring seat member 1096 is secured to the rocker arm 1020 with a threaded fastener and may include a contoured recess 1098 formed therein. The recess 1098 is shaped and oriented such that a gap 1099 is maintained between the retaining flange 1090 and the recess 1098 to permit the buildup of oil and to isolate the spring force from the spring seat member 1096.

Although the present implementations have been described with reference to specific example embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. A system for actuating at least one of two or more engine valves in an internal combustion engine, the system comprising:

at least one dedicated rocker for actuating the at least one of two or more engine valves in an auxiliary operation;

a motion source for imparting motion to a motion source side of the dedicated rocker;

a motion receiving component for receiving motion from a motion receiving component side of the dedicated rocker; and a rocker motion control assembly for controlling motion of the dedicated rocker, the rocker motion control assembly comprising:

a biasing component for biasing the dedicated rocker in a biased direction such that the motion source side of the dedicated rocker tends to move away from the motion source; and a limiting component for limiting the motion of the dedicated rocker in the biased direction, the limiting component defining a positive stop adapted to be engaged by the dedicated rocker.

2. The system of claim 1, wherein the biasing component is adapted to apply a biasing force on the motion receiving component side of the dedicated rocker.

3. The system of claim 2, wherein the biasing component includes a spring adapted to engage a surface on the dedicated rocker.

4. The system of claim 1, wherein the limiting component is adapted to engage the motion source side of the dedicated rocker.

5. The system of claim 4, wherein the limiting component is an adjustable stop.

6. The system of claim 1, wherein the biasing component is adapted to apply a biasing force on the motion source side of the dedicated rocker.

7. The system of claim 1, wherein the biasing component includes a pin secured to the rocker and a spring adapted to apply a biasing force to the pin.

8. The system of claim 7, wherein the pin extends within a pin guide for guiding the pin for sliding movement relative thereto.

9. The system of claim 8, wherein limiting component includes a shoulder on the pin for limiting movement of the pin relative to the guide.

10. The system of claim 1, further comprising a main event rocker for conveying main event valve motion, wherein the biasing component is cooperatively associated with the main event rocker.

11. The system of claim 10, wherein the biasing component comprises a spring disposed between the main event rocker and the dedicated rocker.

12. The system of claim 1, further comprising a main event rocker for conveying main event valve motion, wherein the limiting component comprises a stop on the dedicated rocker adapted to engage the main event rocker.

13. The system of claim 1, further comprising a main event rocker for conveying main event valve motion, wherein the limiting component comprises a first stop on the dedicated rocker adapted to engage a second stop on the main event rocker.

14. The system of claim 1, wherein the rocker motion control assembly includes a biasing assembly for biasing the rocker towards a neutral position in which the rocker motion source side is out of engagement with the motion source and the rocker motion receiving component side is out of engagement with the motion receiving component.

15. The system of claim 1, wherein the dedicated rocker is adapted to move within a range of motion defined by the motion source and the limiting component and wherein the biasing component is arranged to apply a continuous biasing force to the dedicated rocker throughout the range of motion.

16. The system of claim 1, wherein the dedicated rocker is adapted to move on a rocker shaft and wherein the limiting component includes a rocker engagement surface that remains in a fixed position relative to the motion of the rocker.

17. The system of claim 1, wherein the biasing component comprises a hydraulic piston.

18. The system of claim 1, further comprising a rocker shaft, wherein the biasing component comprises a torsion spring situated around the rocker shaft.

19. The system of claim 1, wherein the biasing component comprises a spring disposed between a support plate, fixed relative to an engine cylinder head, and a spring retainer supported on a retaining flange secured to the end of a fastener extending through the support plate.

20. A system for actuating at least one of two or more engine valves in an internal combustion engine, the system comprising:

at least one dedicated rocker for actuating the at least one of two or more engine valves in an auxiliary operation;

a motion source for imparting motion to a motion source side of the dedicated rocker;

a motion receiving component for receiving motion from a motion receiving component side of the dedicated rocker; and a rocker motion control assembly for controlling motion of the dedicated rocker, the rocker motion control assembly comprising:

a biasing component arranged to apply a continuous biasing force to the dedicated rocker in a biased direction, the biasing force tending to move the motion source side of the dedicated rocker away from the motion source; and a limiting component for engaging the dedicated rocker and thereby limiting the motion of the dedicated rocker in the biased direction, wherein the biasing component and limiting component cooperate with the dedicated rocker to maintain the dedicated rocker in a positively defined position when the dedicated rocker is not engaged with the motion source.

* * * * *